US007834812B2

(12) United States Patent
Kai et al.

(10) Patent No.: US 7,834,812 B2
(45) Date of Patent: Nov. 16, 2010

(54) LOOP ANTENNA

(75) Inventors: Manabu Kai, Kawasaki (JP); Toru Maniwa, Kawasaki (JP); Takashi Yamagajo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/629,693

(22) Filed: Dec. 2, 2009

(65) Prior Publication Data

US 2010/0072287 A1 Mar. 25, 2010

Related U.S. Application Data

(63) Continuation of application No. PCT/JP2007/000717, filed on Jun. 29, 2007.

(51) Int. Cl.
*H01Q 11/12* (2006.01)

(52) U.S. Cl. ..... 343/741; 343/866; 235/492; 340/572.8

(58) Field of Classification Search ..... 343/700 MS, 343/741, 742, 866, 867; 235/492; 340/572.1, 340/572.8
See application file for complete search history.

(56) References Cited

U.S. PATENT DOCUMENTS

| | | | | |
|---|---|---|---|---|
| 4,769,656 | A | 9/1988 | Dickey | |
| 4,924,237 | A * | 5/1990 | Honda et al. | 343/702 |
| 5,402,134 | A * | 3/1995 | Miller et al. | 343/742 |
| 6,028,559 | A | 2/2000 | Satoh et al. | |
| 7,323,994 | B2 * | 1/2008 | Yamagajo et al. | 340/572.7 |
| 7,466,277 | B2 * | 12/2008 | Ishizuka et al. | 343/702 |
| 2002/0096568 | A1 | 7/2002 | Arisawa | |
| 2006/0032926 | A1 | 2/2006 | Baba et al. | |
| 2007/0008134 | A1 | 1/2007 | Kai | |
| 2009/0256763 | A1 * | 10/2009 | Chi et al. | 343/741 |
| 2010/0090015 | A1 * | 4/2010 | Sakama | 235/492 |

FOREIGN PATENT DOCUMENTS

EP 0831547 A2 3/1998

(Continued)

OTHER PUBLICATIONS

Size Reduction in UHF Band RFID Tag Antenna Based on Circular Loop Antenna, Hong-Kyun Ryu; Jong-Myung Woo; Applied Electromagnetics and Communications, 2005. ICECom 2005. 18th International Conference on Oct. 12-14, 2005 pp. 1-4.

(Continued)

*Primary Examiner*—Tho G Phan
(74) *Attorney, Agent, or Firm*—Hanify & King, P.C.

(57) ABSTRACT

A loop antenna includes a dielectric substrate taking a cuboid form, and a loop part composed of a metal that covers two pairs of facing surfaces of the dielectric substrate. The loop part is formed by leaving a blank portion at the center of one surface of the pair of facing surfaces having a wider area. In the blank portion, a feeding point to an LSI chip and a capacitance part connected to the loop part in parallel to the feeding point are formed. The capacitance part is provided to compensate for an internal capacitance of the LSI chip so that a small LSI chip matches the antenna. A convex part having a length is arranged with a gap within a corresponding concave part to form a large capacitance.

18 Claims, 15 Drawing Sheets

FOREIGN PATENT DOCUMENTS

| | | |
|---|---|---|
| GB | 2308745 | 7/1997 |
| JP | 05-347509 | 12/1993 |
| JP | B2-2675322 | 7/1997 |
| JP | 10-303635 | 11/1998 |
| JP | B2-3046233 | 3/2000 |
| JP | B2-3180683 | 4/2001 |
| JP | 2004-080736 | 3/2004 |
| JP | B2-3649374 | 2/2005 |
| JP | 2005-191882 | 7/2005 |
| JP | 2006-53833 | 2/2006 |
| JP | 2006-333192 | 12/2006 |
| JP | 2006-333403 | 12/2006 |
| JP | 2007-019905 | 1/2007 |
| JP | 2007-068073 | 3/2007 |
| JP | 2007-088661 | 4/2007 |

OTHER PUBLICATIONS

International Search Report dated Jul. 24, 2007.

* cited by examiner $$f_0 = \frac{1}{2\pi\sqrt{LC}}$$

PRIOR ART

FIG. 3

LOOP ANTENNA

CROSS-REFERENCE TO RELATED APPLICATION

This application is a continuation application of international PCT application No. PCT/JP2007/000717 filed on Jun. 29, 2007.

FIELD

The present invention relates to a loop antenna of a tag that can be attached to a metal in an RFID (Radio Frequency Identification) system.

BACKGROUND

Conventionally, an RFID system where a reader/writer identifies a tag by transmitting a radio wave of approximately one watt from the reader/writer, by receiving the signal on the tag side, and by returning information within the tag to the reader/writer with a radio wave, has been put into practical use.

For this RFID system, a radio signal of a frequency of the UHF (Ultra High Frequency) band (865 MHz in EU, 915 MHz in US, and 953 MHz in JP) is used.

In a tag, an LSI (Large Scale Integrated) chip and an antenna are directly connected in normal cases. The pattern of the antenna is formed by etching Cu evaporated onto an insulative sheet such as a film, paper, etc. or by coating with an Ag paste. Normally, the size of the antenna pattern is approximately 100 to 150 mm×10 to 25 mm.

If the antenna of the tag is a normal dipole antenna, a communication distance between the reader/writer and the tag is approximately 3 to 5 m, although it depends on the operating power of the LSI chip of the tag.

Additionally, as an antenna that can extend the communication distance between the reader/writer and the tag, a circular loop antenna that is small enough to fit within an area of 97.5 $mm^2$ by 54 $mm^2$ is proposed (for example, see "Size Reduction in UHF Band RFID Tag Antenna Based on Circular Loop Antenna", Hong-Kyun Ryu; Jong-Myung Woo; Applied Electromagnetics and Communications, 2005. ICECom 2005. 18th International Conference on 12-14 Oct. 2005 Page(s): 1-4).

Since the RFID tag is normally used by being attached to a commodity, etc., it is generally designed in consideration of the permittivity, the thickness, etc., of an object to which the tag is attached.

However, if such a normal tag described above is attached to a metal, a radio wave emitted from the reader/writer is not picked up by the tag, or an antenna gain becomes extremely small because the metal to which the tag is attached serves as an obstacle. Therefore, the emission of a radio wave returned from the tag cannot be obtained.

This is also similar in the above described dipole antenna and circular loop antenna.

To solve this problem, an antenna of a completely different shape becomes necessary. For example, a loop antenna that uses metal surfaces has been used, on the contrary, for a long time.

FIG. 1 is an explanatory view of the principle of a conventional loop antenna that uses metal surfaces. This figure schematically illustrates a state where a tag 4 composed of an LSI chip 2 and a loop antenna 3 is made to contact a surface of a metal 1 (viewed from the side of the metal 1, the metal 1 being in the form of a plate).

The loop antenna 3 is composed of a top 5, a bottom 6 and both sides 7 of a loop. The loop antenna 3 is arranged so that the bottom 6 of the loop is positioned along a surface of the metal 1 and the loop is made orthogonal to the surface of the metal 1.

Here, when a radio wave from the reader/writer is emitted in a direction indicated by an arrow 8, an electric current in a direction indicated by arrows 9 is induced in the loop antenna 3 of the tag 4.

The loop of the loop antenna 4 is arranged orthogonal to the surface of the metal 1 as described above. Therefore, the electric current induced in the loop antenna 4 forms the eddy current indicated by the arrows 9 on the surface orthogonal to the surface of the metal 1.

If an eddy current occurs on a surface orthogonal to one of a surfaces of a metal, the metal surface normally works as if it was a mirror, and an electric current component that flows in a mirror image path 5', 6' and 7', indicated by a broken line in a direction indicated by arrows 9' (direction reverse to the previously mentioned eddy current) in FIG. 1, also occurs orthogonally to the other surface of the metal and symmetrically to the original surface. This phenomenon is called a mirror image effect.

If mutually opposing eddy currents occur at positions that are orthogonal to and symmetrical with the metal surface as described above, the electric current components at the bottom 6 and in the mirror image path 6' of the loop in the metal surface portion on both of the surfaces of the metal cancel each other out, and only electric current components at the top 5 and both of the sides 7 of the loop, and in the mirror image path 5' and 7' remain.

The remaining current components form an eddy current component that flows along both of the surfaces of the metal as if it penetrated through the metal surface, as virtually illustrated with a solid line 10. As a result, the loop antenna 3 can obtain a very large antenna gain.

FIG. 2 illustrates an equivalent circuit of the LSI chip 2 and the loop antenna 3 of the above described tag 4. The LSI chip 2 normally includes a parallel resistance Rc (approximately 200 to 2000Ω) and a parallel capacitance Cc (approximately 0.2 to 2 pF).

FIG. 3 is an equation for calculating a condition under which the above described LSI chip and loop antenna match at a predetermined resonance frequency. f0, L and C represent the resonance frequency, an inductance and a capacitance, respectively.

Here, to make the LSI chip 2 and the loop antenna 3 of the tag 4 illustrated in FIG. 1 match, it is known to be preferable that the parallel inductance La of the loop antenna 3 and the parallel capacitance Cc of the LSI chip 2 cancel each other out if the parallel resistance Ra of the loop antenna 3 illustrated in FIG. 2 has the same value as the parallel resistance Rc of the LSI chip 2 and if the parallel inductance La of the loop antenna 3 exists in the relationship of FIG. 3.

At this time, all of the induced power of the radio wave received by the loop antenna 3 is supplied to the LSI chip 2. Moreover, all of the power from the LSI chip 2 is supplied to the loop antenna 3, and is externally emitted.

In the meantime, the loop antenna has a nature such that its loop length is automatically determined when the size and the permittivity $\in r$ of a substrate holding the loop antenna are determined.

Accordingly, if the loop antenna 3 has a parallel inductance component La that satisfies the equation in FIG. 3 in the tag 4 that takes the shape illustrated in FIG. 1 and includes the equivalent circuit illustrated in FIG. 2, the loop antenna 3 matches the LSI chip 2. However, sometimes the value of the parallel inductance component La does not reach a value that satisfies the equation of FIG. 3, depending on the size or the permittivity ∈r of the holding substrate.

FIG. 4 illustrates a simulation model created to conduct a performance test of the loop antenna 3 of the tag 4 schematically illustrated in FIG. 1.

In the model tag 11 illustrated in FIG. 4, the size of the cuboid, namely, the size of the longer side×the shorter side× the thickness is set to 50.8 mm×25.4 mm×5.4 mm. Originally, an LSI chip is connected to a feeding part at the ends of both of the feeding terminals 130 at the center of the loop antenna 120. However, a simulation port surface 140 is formed here.

It should be assumed that this loop antenna 120 is formed by pasting copper (Cu) foil onto the surfaces of the holding substrate 150 that is insulative and slightly transparent. It should also be assumed that the entirety of the surfaces of the tag 11 are molded by a resin for environmental resistance, although the mold resin is not illustrated due to its transparency.

Additionally, an LSI chip to be mounted on the port surface 140 is actually the size of an LSI package that protects and accommodates the LSI chip. Therefore, the size of the LSI package is assumed to be 10 mm×10 mm.

Furthermore, it should be assumed that the permittivity ∈r of the holding substrate 150 and the mold resin is 3.7. In this configuration, it should also be assumed that the parallel resistance Rc of the LSI chip, which is made to match the loop antenna 120, is 1000 to 2000Ω, and the parallel capacitance Cc is 0.8 pF in the equivalent circuit illustrated in FIG. 2.

To make the loop antenna 120 match this LSI chip, it is most ideal, based on the equation of FIG. 3, that the parallel resistance Ra of the loop antenna 120 be 1000 to 2000Ω, and the parallel inductance La be 35 nH.

According to calculation results obtained by simulating the above described model under the above described conditions with a commonly sold electro-magnetic field simulator, Ra and La are respectively 8000Ω and 20 nH, which are far from the above described ideal values, and do not match the LSI chip at all.

The capacitance Cc of the LSI chip that can cope with the loop antenna having Ra of 8000Ω and La of 20 nH, which are obtained from the simulation, is 2.0 pF on the basis of the equation represented by FIG. 3. Such an LSI chip for a tag is impractical.

Here, assuming that the permittivity ∈r of the holding substrate 150 is increased to approximately 10, the parallel inductance La of the loop antenna 120 is in the vicinity of 35 nH. Therefore, this loop antenna matches the LSI chip.

However, ceramics having a very high permittivity ∈r are forced to be used as the holding substrate 150 in this case. A normal holding substrate 150 is currently commonly sold at a price of approximately 100 yen, while a ceramic substrate taking the same shape costs more than 1000 yen. Accordingly, the cost of the entire tag increases, which is not cost-effective.

Additionally, if the size of the holding substrate 150 is increased to approximately 80×50 mm, the loop length of the loop antenna formed on the surface of the holding substrate 150 also becomes longer with an increase in the size of the holding substrate 150. Then, the parallel inductance component La of the loop antenna ends up in the vicinity of 35 nH, which almost matches the LSI chip having a parallel resistance Rc of 1000 to 2000Ω and a parallel capacitance Cc of 0.8 pF.

In this case, however, the loop antenna, namely, the holding substrate, becomes huge, and exceeds a practical size as a tag.

SUMMARY

An object of the present invention is to provide a loop antenna of a tag which can make an LSI chip and a loop antenna match by using a small inexpensive dielectric substrate having a low permittivity and the performance of which is not deteriorated when it is attached to a metal surface.

A loop antenna according to the present invention is configured to include: a dielectric substrate taking a cuboid form; a loop part composed of a metal that covers two pairs of facing surfaces of the dielectric substrate by leaving a blank portion at the center of one surface of one pair of facing surfaces having a wider area; a feeding point to an LSI chip, formed in the blank portion of the loop part; and a capacitance part formed by being connected to the loop part in parallel to the feeding point.

The capacitance part is configured, for example, with conductors closely arranged at two positions via a gap.

In this case, in the capacitance part, the conductors arranged at the two positions may be configured, for example, to take the form of almost identical rectangles. Additionally, the capacitance part may be configured, for example, by forming a concave part in one of the conductors arranged at the two positions, and by forming in the other conductor a convex part which protrudes into the concave part.

In this loop antenna, the metal that covers the one pair of facing surfaces having a wider area is, for example, a thin plate or foil formed integrally with the dielectric substrate in advance by being coated or pasted onto the dielectric substrate, and the feeding point and the capacitance part are formed by etching the thin plate or foil metal.

Additionally, in this loop antenna, the metal that covers one surface of the one pair of facing surfaces having a wider area is a conductive sheet pasted onto the dielectric substrate later, and the metal that covers the other surface is a conductive sheet pasted onto the dielectric substrate after the feeding point and the capacitance part are formed in advance and pasted onto a non-conductive sheet.

In these cases, the metal that covers the pair of facing surfaces having a narrower area among the two pairs of facing surfaces is, for example, a metal to be plated, or a conductive tape member.

Furthermore, this loop antenna may be configured to further include a resin material that molds the dielectric substrate, the loop part, the feeding point, and the capacitance part along with the LSI chip.

BRIEF DESCRIPTION OF DRAWINGS

FIG. 3 represents an equation for calculating a condition under which the LSI chip and the loop antenna of the tag match at a predetermined resonance frequency;

DESCRIPTION OF EMBODIMENTS

First Embodiment

Figure 1:
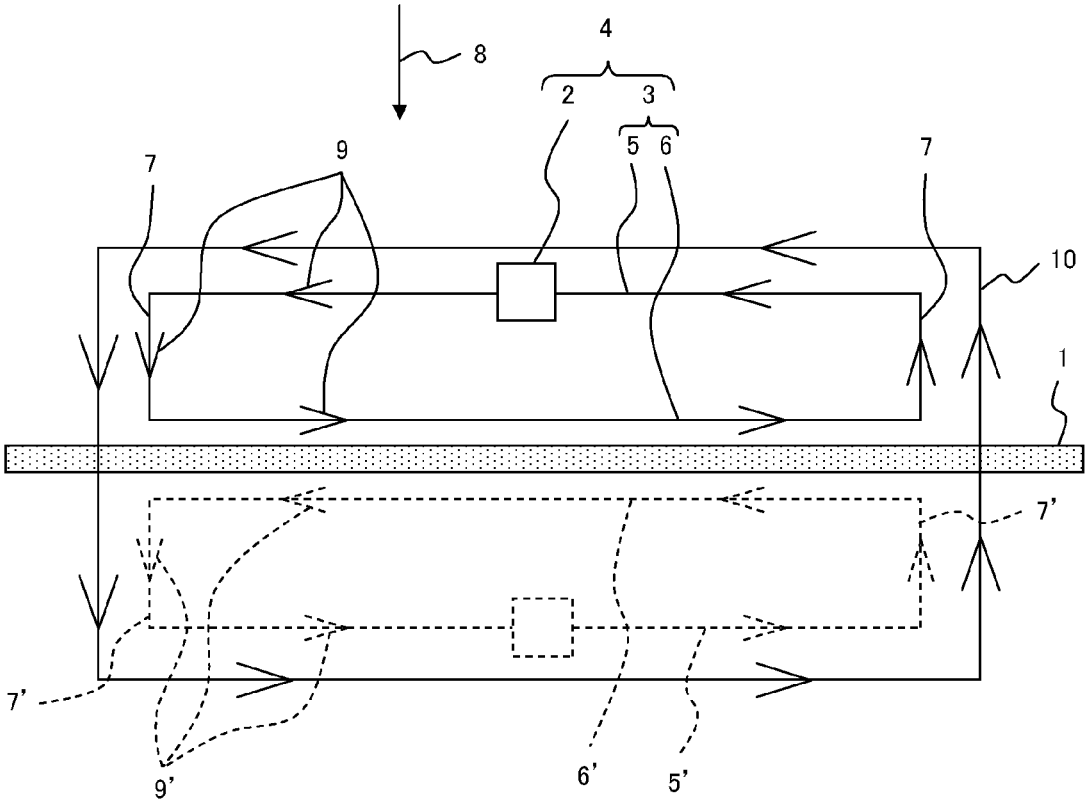
PRIOR ART FIG. 1
FIG. 1 is an explanatory view of the principle of a conventional loop antenna using metal surfaces.
Figure 2:
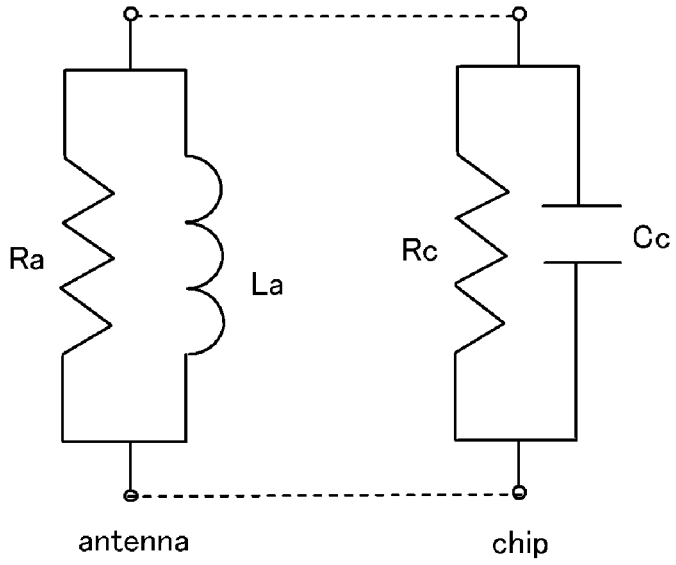
PRIOR ART FIG. 2
FIG. 2 illustrates an equivalent circuit of an LSI chip and the loop antenna of a tag illustrated in the explanatory view of the principle illustrated in FIG. 1.
Figure 4:
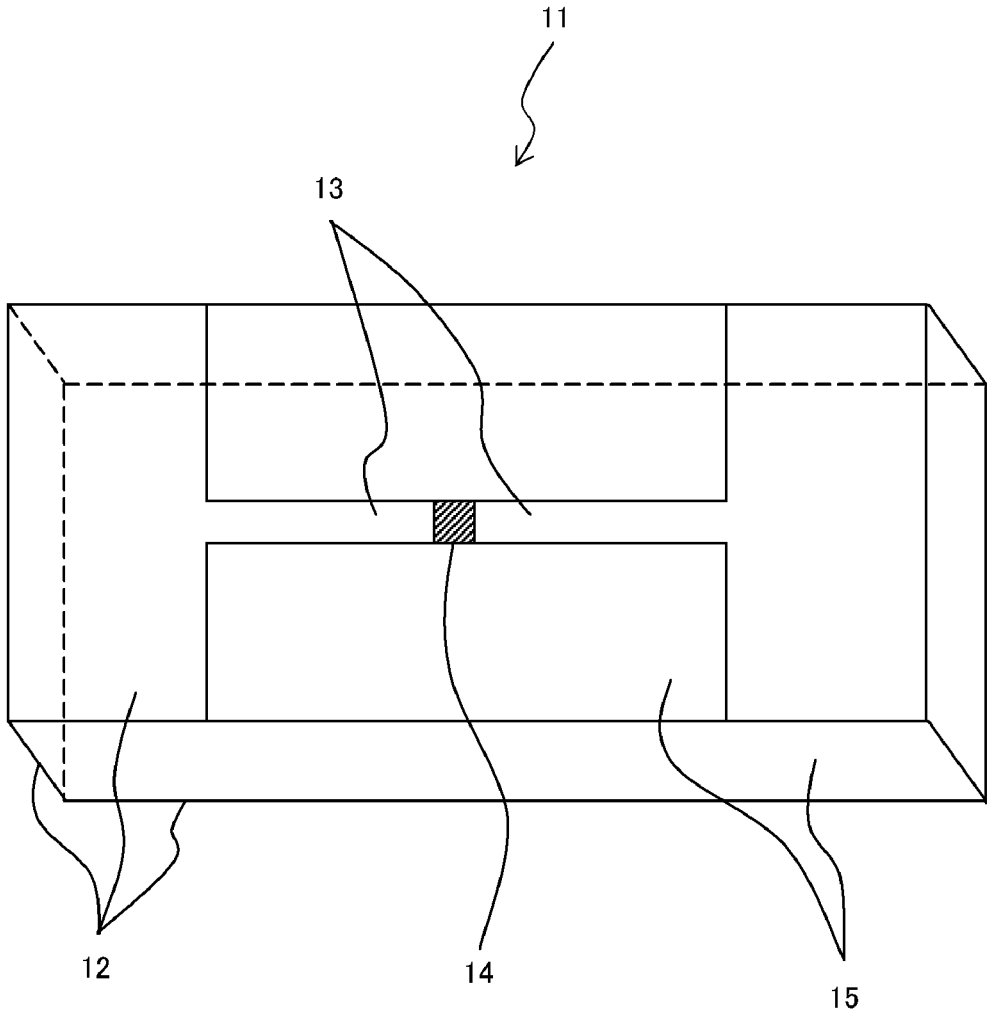
PRIOR ART FIG. 4
FIG. 4 illustrates a simulation model created to conduct a performance test of the conventional loop antenna attached to a metal surface.
Figure 5:
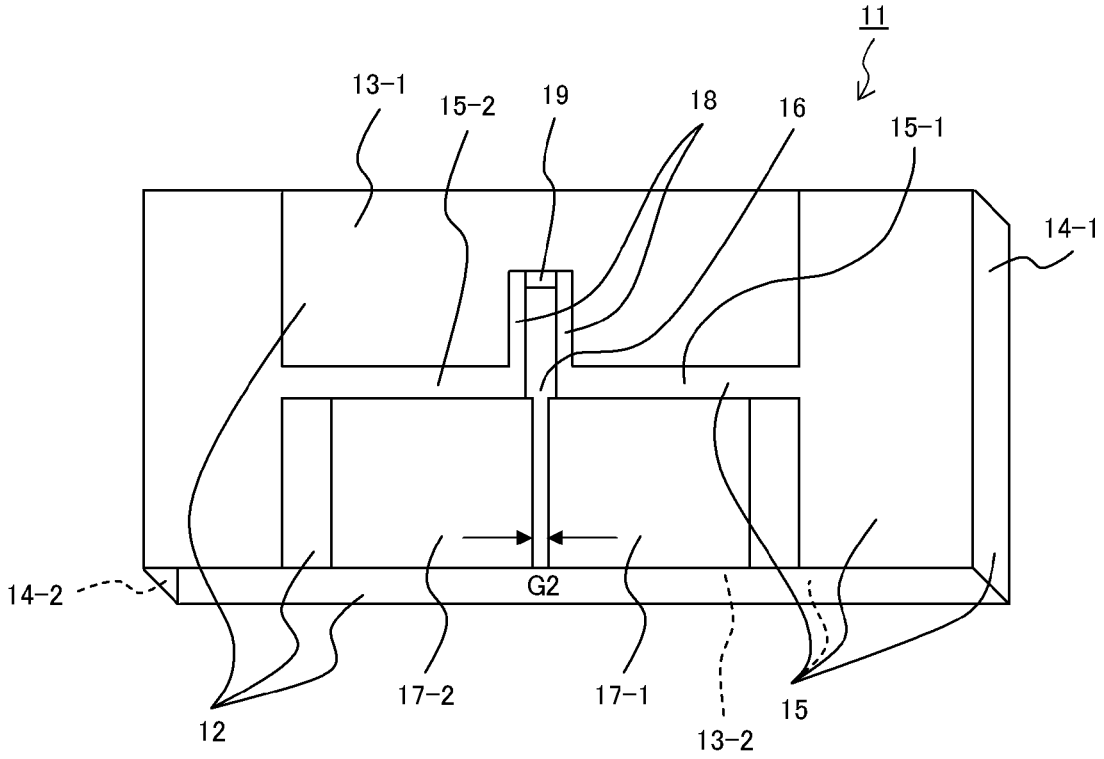
FIG. 5 illustrates a loop antenna of a tag according to a first embodiment of the present invention.

FIG. 5 illustrates a loop antenna of a tag according to a first embodiment of the present invention.

As illustrated in FIG. 5, the tag 11 includes a dielectric substrate 12 taking a cuboid form, and a loop part 15 composed of a metal that covers two pairs of facing surfaces 13-1, 13-2 and 14-1, 14-2 of the dielectric substrate 12.

Note that, the loop part 15 is formed by being arranged on the entirety of one surface 13-2 of the pair of facing surfaces 13-1 and 13-2 having a wider area, and by leaving a blank portion at the center of the other surface 13-1.

In the blank portion, loop thin line parts 15-1 and 15-2, which are obtained by thinning and extending the loop part 15, are arranged. The ends of the loop thin line parts 15-1 and 15-2 face each other to form a feeding point 16 to the LSI chip.

The tag 11 further includes a capacitance part 17 (17-1, 17-2) formed by being connected to the loop thin line parts 15-1 and 15-2 in parallel to the feeding point 16 at which the ends of the loop thin line parts 15-1 and 15-2 face each other.

In FIG. 5, wires 18 that respectively extend in one direction (upward in FIG. 5) from both of the ends of the loop thin line parts 15-1 and 15-2, which form the feeding point 16 of the shorter side of the dielectric substrate 12, and a port surface 19, used for a simulation, formed between the tips of the wires 18 are formed as a replacement for the LSI chip connected to the feeding point 16.

The above described capacitance part 17 is composed of conductors 17-1 and 17-2 that are closely arranged at two points via a gap G2. In the example illustrated in FIG. 5, the conductors 17-1 and 17-2 arranged at the two points respectively take the form of almost identical rectangles.

This capacitance part 17 is intended to compensate for a lack in the capacitance of the LSI chip in order to make the loop antenna 15 cope with such a small LSI chip that has, for example, an Rc of 1000 to 2000Ω and a Cc of 0.8 pF.

Figure 6:
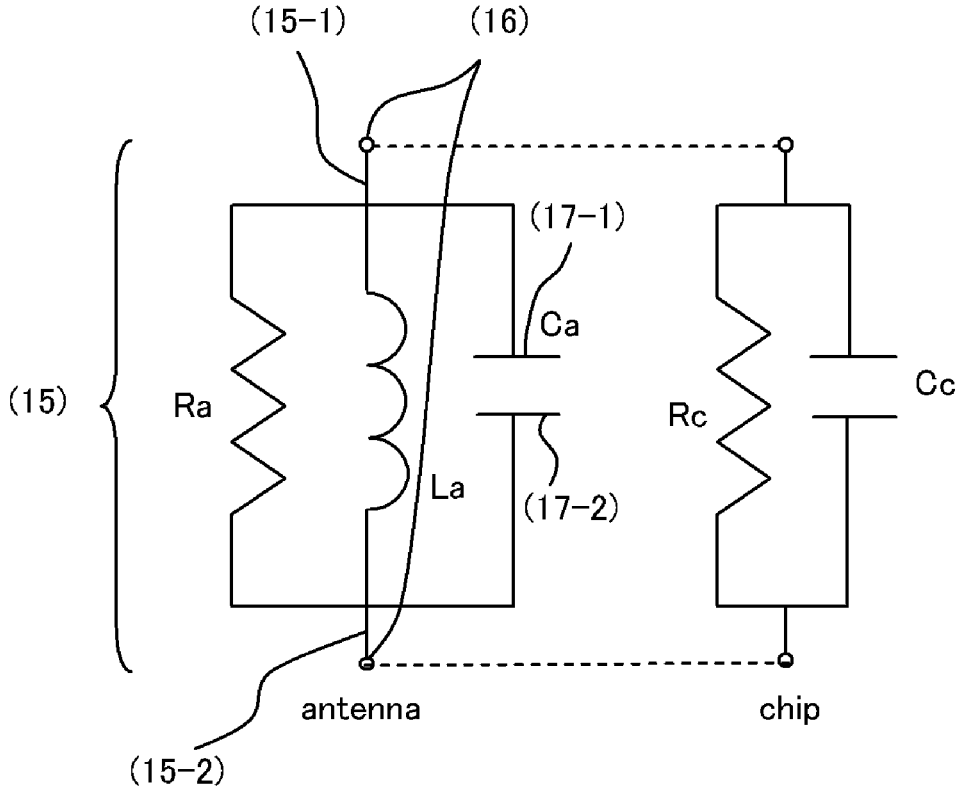
FIG. 6 illustrates an equivalent circuit of the tag according to the first embodiment.

FIG. 6 illustrates an equivalent circuit of the above described tag 11. In this figure, circuit portions corresponding to the configuration of the loop antenna 11 illustrated in FIG. 5 are denoted with the same reference numerals as FIG. 5 but in parentheses. As illustrated in FIG. 6, a parallel capacitance part Ca of the loop antenna 15 is supplementarily added to the tag 11 according to this embodiment.

Namely, this configuration is devised in the basis of the concept of deeming it sufficient that the Cc of the LSI chip and the Ca of the loop antenna 15 are resonant with the La of the loop antenna (the relationship of FIG. 3 is satisfied).

As the width of the gap G2 between the conductors 17-1 and 17-2 of the capacitance part 17 decreases, the capacitance component Ca increases. Therefore, the loop antenna can cope with an LSI having a smaller Cc.

Additionally, as the length of the gap G2 increases, so does the capacitance component Ca. However, the length of the gap G2 has a ceiling in the configuration illustrated in FIG. 5.

Second Embodiment

Figure 7:
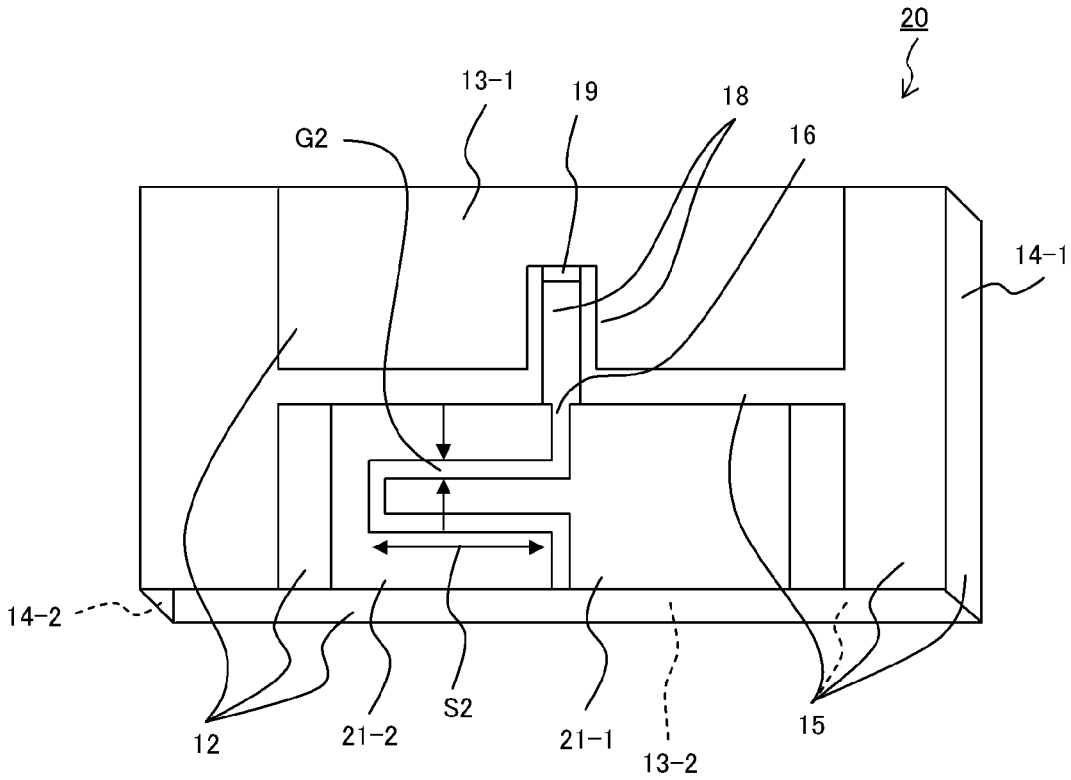
FIG. 7 illustrates a loop antenna of a tag according to a second embodiment of the present invention.

FIG. 7 illustrates a loop antenna of a tag according to a second embodiment. In FIG. 7, the same components as those of the tag 11 illustrated in FIG. 5 are denoted with the same reference numerals as in FIG. 5.

As illustrated in FIG. 7, the components in the tag 20 according to this embodiment are the same as those of the tag 11 illustrated in FIG. 5 except that the shape of the capacitance part 21 (21-1, 21-2) is different from that of the capacitance part 17 (17-1, 17-2) of the tag 11 illustrated in FIG. 5.

In this embodiment, in the capacitance part 21, a concave part is formed in one (conductor 17-2) of the conductors 17-1 and 17-2 arranged at two positions, and a convex part that protrudes into the concave part of the conductor 17-2 is formed in the other conductor 17-1.

A gap G2 similar to that of FIG. 5, which includes the facing parts of the concave and the convex parts, is formed between the conductors 17-1 and 17-2.

In this embodiment, the length of the gap G2 formed between the conductors 17-1 and 17-2 is longer because the convex part protrudes into the concave part. Therefore, the capacitance component Ca becomes larger than that of FIG. 5.

Namely, as the width of the gap G2 decreases and the length S2 of the convex part increases, the capacitance component Ca increases. As a result, the loop antenna can cope with an LSI chip of a smaller Cc. Also an equivalent circuit of this embodiment can be represented with FIG. 6.

(Matching Between the Loop Antenna and the LSI Chip According to the First and the Second Embodiments)

Figure 8:
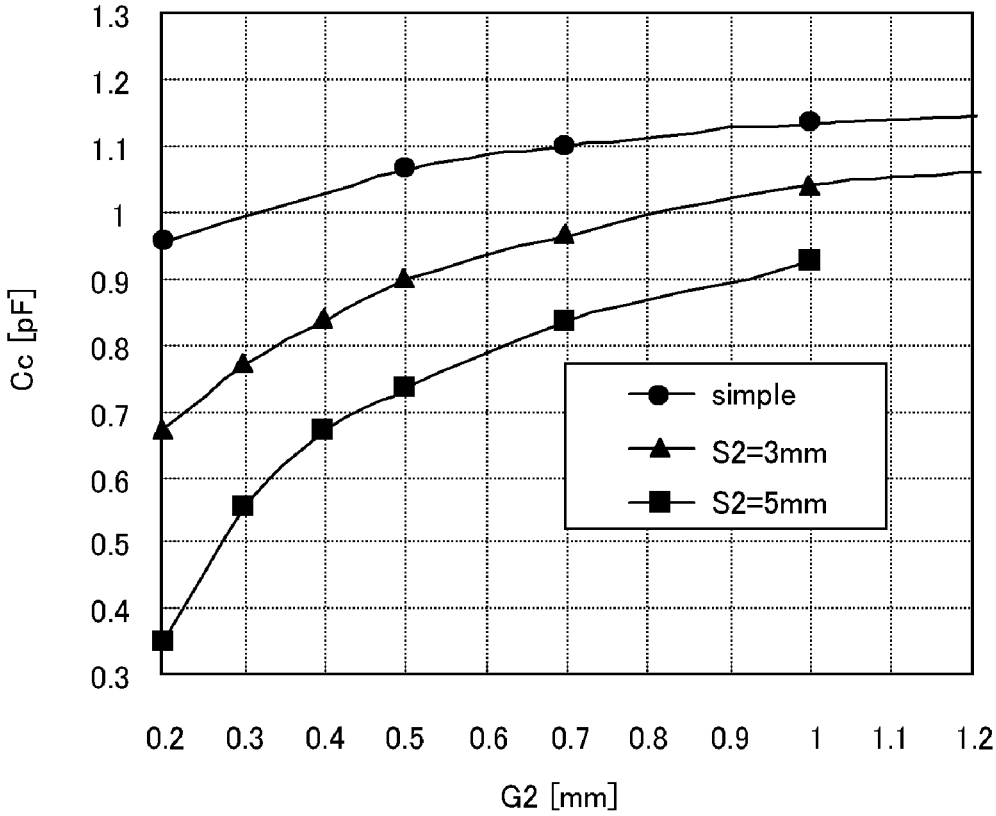
FIG. 8 illustrates the value of Cc of an LSI chip that can cope with a loop antenna in the case where only a gap G2 is formed in a capacitance part of the loop antenna of the tag, and in the case where the gap G2 and a length S2 of a convex part are formed.

FIG. 8 illustrates characteristics of the value of Cc of the LSI chip that can cope with the loop antenna in the case where only the gap G2 in the first embodiment is formed in the capacitance part of the loop antenna of the tag, and in the case where the gap G2 and the length S2 of the convex part in the second embodiment are formed.

Also, this figure illustrating the characteristics is obtained as a result of making calculations for the tag 11 illustrated in FIG. 5 and the tag 20 illustrated in FIG. 7 as a model by using the above described G2 and S2 as parameters when using a commonly sold electro-magnetic simulator.

In FIG. 8, the horizontal and the vertical axes respectively represent the width of the gap G2 (mm) and the Cc (pF) of the LSI chip, three graphs representing the characteristics are respectively depicted with black circle plots in the case of the first embodiment (depicted as "simple" here), with black triangle plots in the case where the length S2 of the convex part is 3 mm in the second embodiment, and with black square plots in the case where S2 is 5 mm in the second embodiment.

Based on FIG. 8 illustrating the characteristics, in order to cope with the LSI chip having a Cc of 0.8 pF, it is proved to be sufficient that the length S2 of the convex part and the gap G2 of the loop antenna 15 in the second embodiment are respectively set to 3 mm and 0.34 mm, or 5 mm and 0.63 mm.

In the case of the first embodiment (simple), the loop antenna is proved to be suitable for an LSI chip having a Cc of approximately 0.95 to 1.12 pF. Since the Cc of an LSI chip varies depending on the chip maker, the parameters of G2 or S2 may be selected according to each LSI chip.

Figure 9:
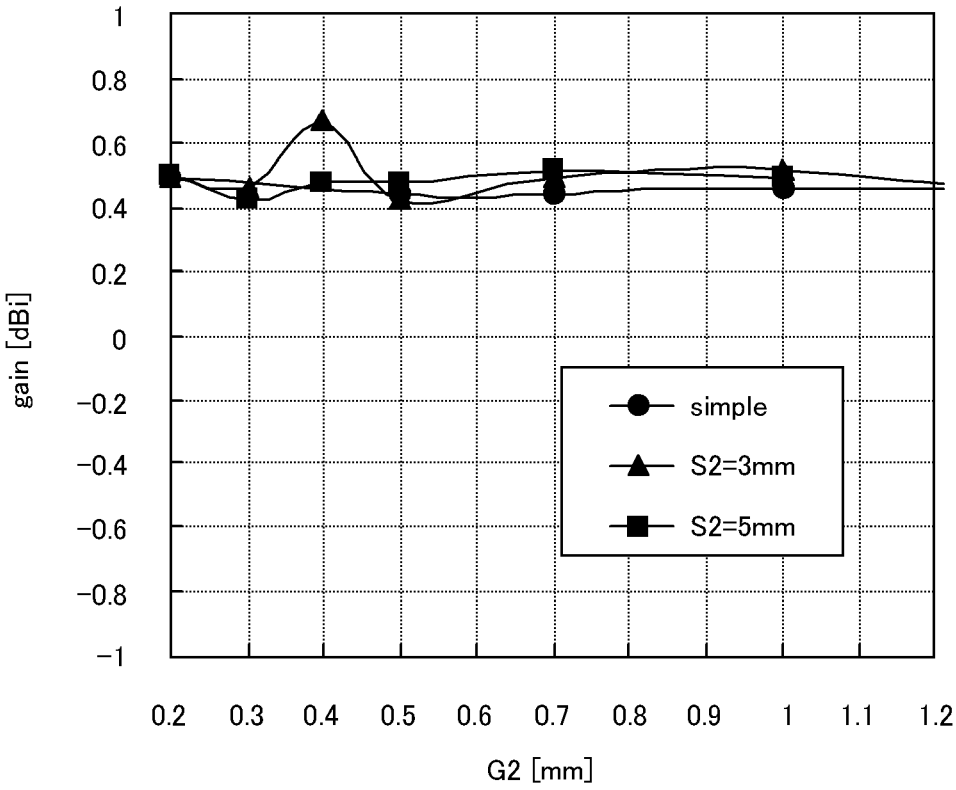
FIG. 9 illustrates characteristics of an antenna gain when parameters are set to conditions similar to those of FIG. 8.

FIG. 9 illustrates characteristics of an antenna gain when the parameters are set to conditions similar to those of FIG. 8. In FIG. 9, the horizontal and the vertical axes respectively represent the width of the gap G2 (mm) and a gain (dBi) of the antenna. Plots of three graphs representing the characteristics are similar to those of FIG. 8.

As illustrated in FIG. 9, the antenna gain reaches a value as high as 0.4 to 0.6 dBi.

Figure 10:
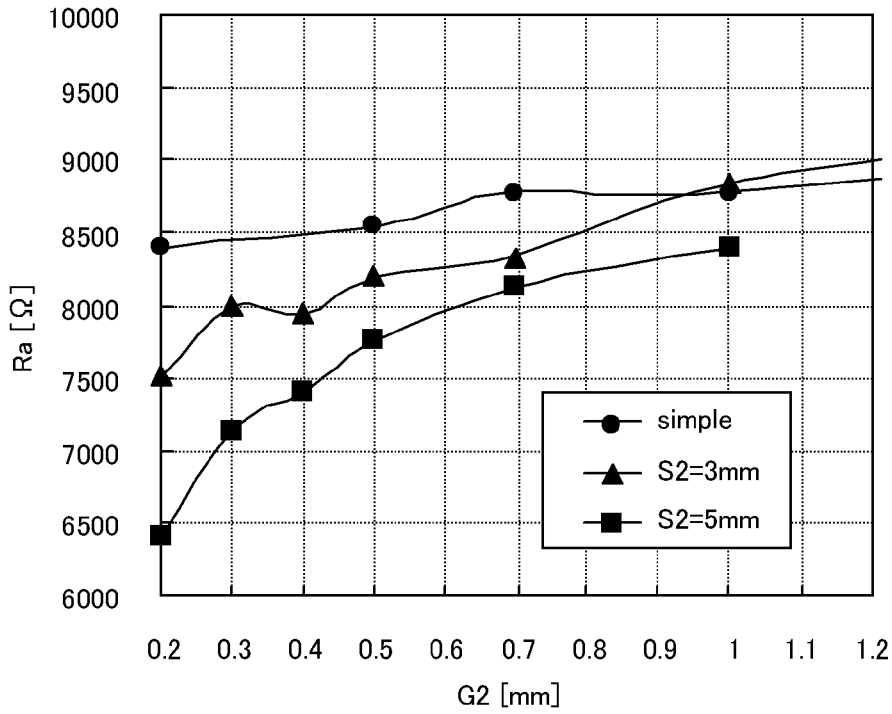
FIG. 10 illustrates a parallel resistance Ra of the loop antenna when the parameters are set to conditions similar to those of FIGS. 8 and 9.

FIG. 10 represents the parallel resistance Ra of the loop antenna 15 when the parameters are set to conditions similar to those of FIGS. 8 and 9. In FIG. 10, the horizontal and the vertical axes respectively represent the width of the gap G2 (mm) and the parallel resistance Ra of the loop antenna 15. Plots of three graphs representing the characteristics are similar to those of FIGS. 8 and 9.

As illustrated in FIG. 10, it is proved that although the three graphs representing the characteristics are somewhat different, the parallel resistance Ra is approximately 8000Ω, though slight mismatches occur.

Figure 11:
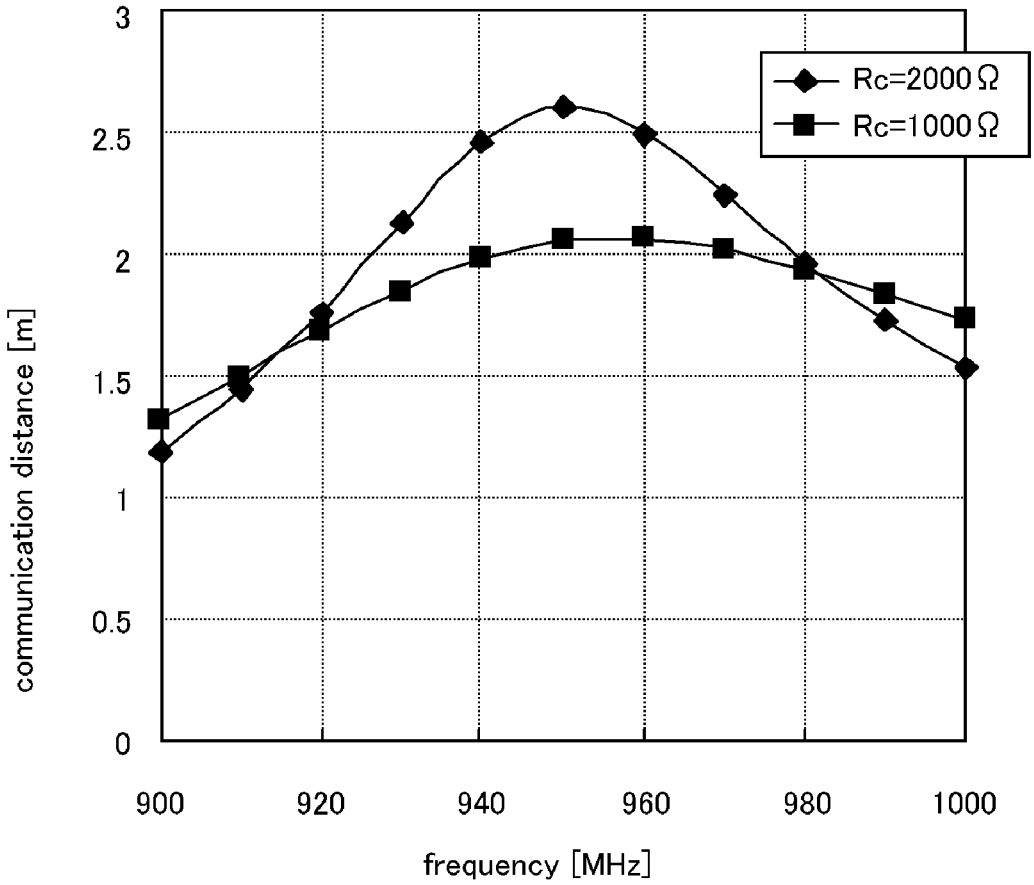
FIG. 11 illustrates results obtained by calculating the frequency characteristic of a communication distance.

FIG. 11 illustrates results obtained by calculating the frequency characteristic of the communication distance. In FIG. 11, the horizontal and the vertical axes respectively represent a frequency (MHz) and the communication distance (m). The case where the parallel resistance Rc of the LSI chip is 1000Ω is depicted with black square plots and the case where Rc is 2000Ω is depicted with black diamond plots.

In addition to the above described settings, in this calculation the output power of the reader/writer is set to 1 W, the gain and the polarization characteristic of the antenna of the reader/writer are set to 6 dBi and the circular polarization, and the operating power of the LSI chip is set to 4 dBm.

As illustrated in FIG. 11, the matching state becomes better in the case where the parallel resistance Rc of the LSI chip is larger. This is because the parallel resistance Rc becomes closer to the parallel resistance Ra of the loop antenna 15. As a result, the communication distance increases. However, there is a disadvantage wherein an adaptable band becomes narrow.

For practical use, it is effective to use the loop antenna for a suitable application purpose in consideration of the above described matter.

(Basic Configuration of the Loop Antenna of the Tag According to the Present Invention)

Figure 12:
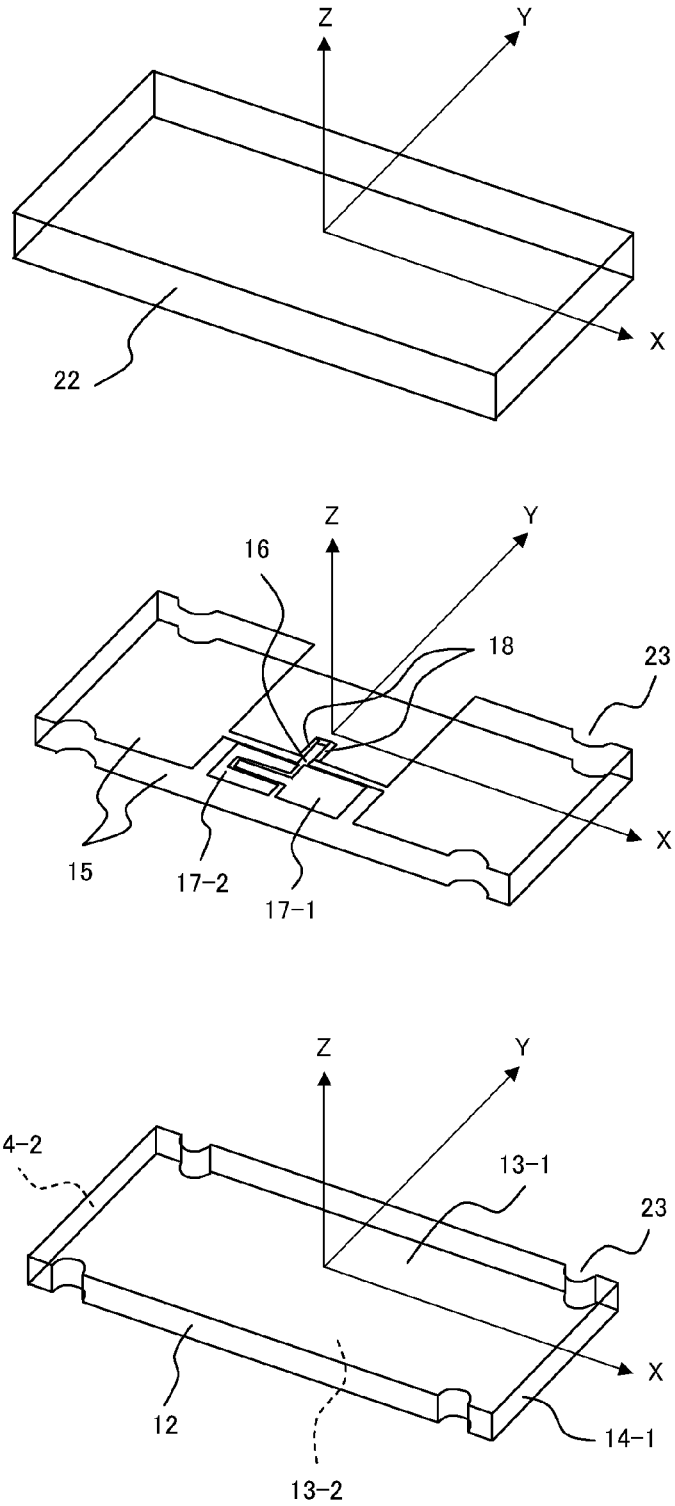
FIG. 12 is a disassembled perspective view illustrating a basic configuration of the loop antenna of the tag according to the present invention.

FIG. 12 is a disassembled perspective view illustrating the basic configuration of the loop antenna of the tag according to the present invention. Figures and descriptions provided below refer to the tag 20 according to the second embodiment illustrated in FIG. 7. Note that, the loop antenna 15 of the tag 11 according to the first embodiment illustrated in FIG. 5 is similar.

Figure 13:
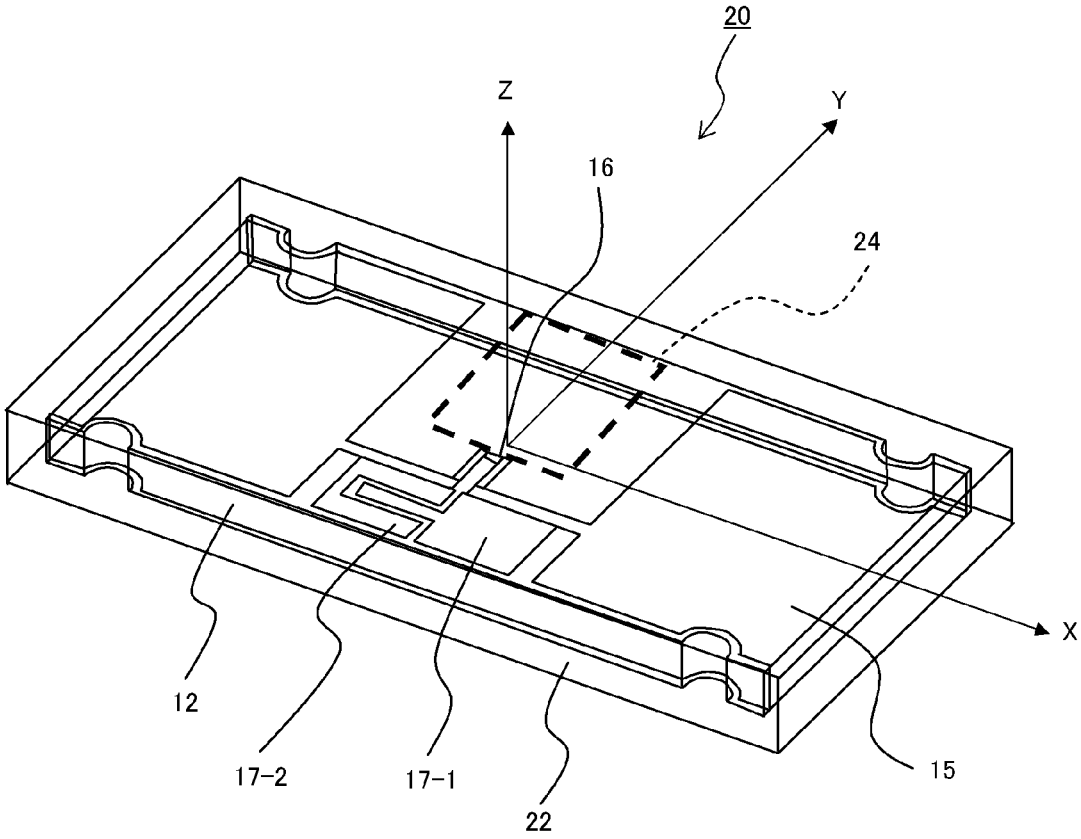
FIG. 13 is a perspective view illustrating an assembled state of the basic configuration of the loop antenna of the tag.

FIG. 13 is a perspective view illustrating the assembled state of the tag illustrated in the disassembled perspective view of FIG. 12.

In FIGS. 12 and 13, the same components or functions as those of the tag 20 illustrated in FIG. 5 or 7 are denoted with the same reference numerals of FIG. 5 or 7.

FIG. 12 illustrates, from the bottom to the top, the dielectric substrate 12 taking an almost cuboid form, the loop antenna 15 of copper (Cu) or silver (Ag) arranged to come into close contact with the surface of the dielectric substrate 12, and a mold resin 22 that covers and protects the entirety of the dielectric substrate 12 and the loop antenna 15.

In FIG. 12, the longer side and the shorter side are respectively assumed to be X and Y directions with respect to the center of the tag as the origin, and a direction perpendicular to the X and the Y directions is assumed to be a Z direction.

Additionally, the size of the dielectric substrate 12 in the longer side and the shorter side is approximately 50. 8 mm and 25.4 mm, and its thickness is approximately 5.4 mm.

Furthermore, a total of four concave parts 23 respectively illustrated at the ends of both sides in the longer sides of the dielectric substrate 12 and the loop antenna 15 are formed for alignment. Therefore, these concave parts 23 are not required for a type of integrating the dielectric substrate 12 and a portion of the loop antenna 15 which will be described later.

In the assembled state illustrated in FIG. 13, the mold resin 22 that is not illustrated in FIGS. 5 and 7 is also depicted. In FIG. 13, an LSI package 100 that accommodates and protects the LSI chip and is connected to the feeding point 16 is depicted with a broken line.

Third Embodiment

Figure 14:
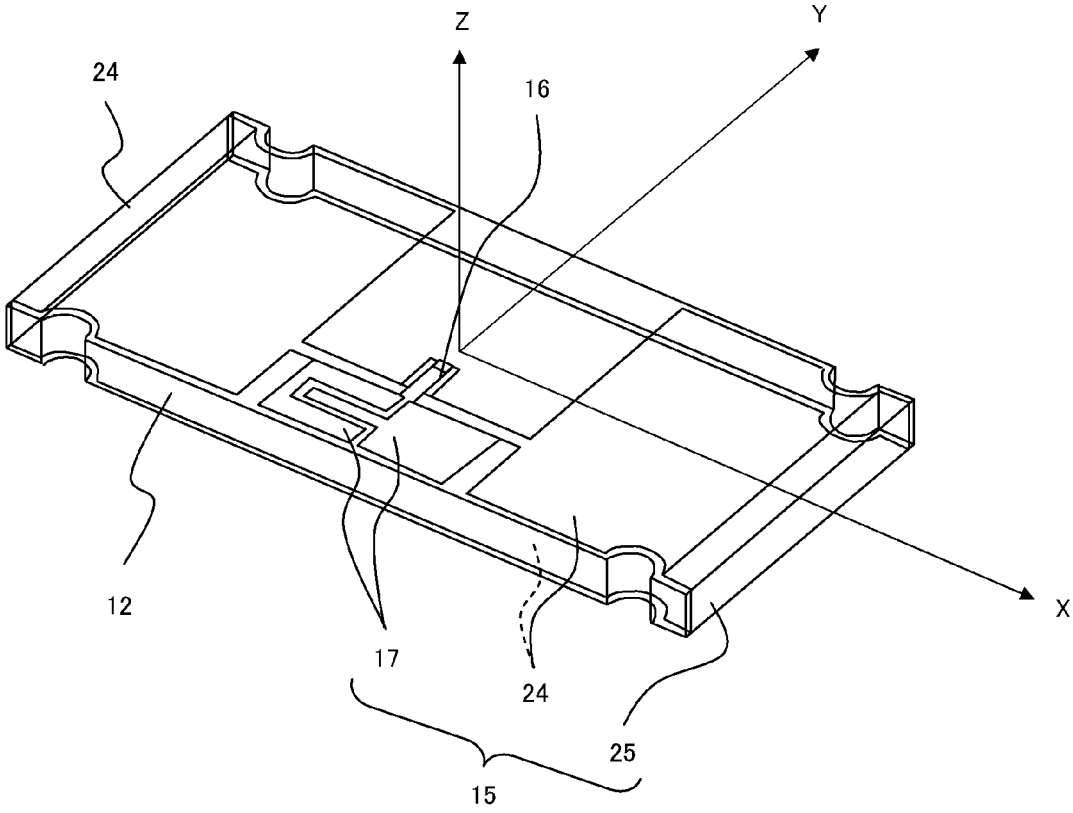
FIG. 14 is an explanatory view of a specific method for manufacturing the loop antenna of the tag according to the present invention, as a third embodiment.

FIG. 14 is an explanatory view of a specific method for manufacturing the loop antenna of the tag according to the present invention as a third embodiment. Figures and descriptions provided below refer to the configuration of the tag 20 according to the second embodiment illustrated in FIG. 7. Also, the loop antenna 15 of the tag 11 according to the first embodiment illustrated in FIG. 5 is similar.

The loop antenna 15 illustrated in FIG. 14 is composed of a metal 24 such as, for example, copper (Cu), silver (Ag), etc., which covers one pair of facing surfaces 13-1 and 13-2 (see the dielectric substrate 12 at the bottom of FIG. 12) having a wider dielectric substrate 12 area, and a conductive tape member 25 that covers the top and bottom of one pair of facing surfaces 14-1 and 14-2 (see the dielectric substrate 12 at the bottom of FIG. 12) having a narrower dielectric substrate 12 area in order to electrically connect the metal 24 of both of the surfaces.

The above described metal 24 is a thin plate or foil, and is integrally formed in advance with the dielectric substrate 12 by being evaporated, coated or pasted onto the dielectric substrate 12. Such a dielectric substrate (high-frequency substrate) of a metal integrated type having a thickness of 5.4 mm is commonly sold at a relatively low price.

This commonly sold metal integrated type dielectric substrate is purchased and cut to 50.8 mm×25.4 mm, whereby a metal integrated type dielectric substrate of both of surfaces, 50.8 mm×25.4 mm×5.4 mm in size, can be obtained. Namely, a dielectric substrate can be obtained from the facing surfaces having the widest area, integrated with a metal, of the three pairs of facing surfaces.

For example, by masking or sandblasting the metal on either the front or back surface of the metal integrated type dielectric substrate, or by etching the metal with a plasma device, etc., the feeding point 16 and the capacitance part 17 are formed.

Thereafter, a commonly sold conductive tape member is cut into a suitable size. One pair of facing surfaces having a narrower front and back surface area on the metal integrated type dielectric substrate, on one surface of which the metal has been etched, is covered on the top and bottom with the cut conductive tape member by using a conductive adhesive. As a result, the loop antenna illustrated in FIG. 14 can be manufactured.

The manufacturing of the tag 20 is finished by connecting the feeding point 16 of the loop antenna 15 and electrodes of the LSI package 100 with soldering or a conductive adhesive.

The process step of connecting the electrodes of the LSI package 100 to the feeding point 16 may be performed before or after a pair of facing surfaces having a narrower area is covered with the conductive tape member.

Additionally, the manufacturing of the tag 20 is finished in the state where the LSI package 100 is connected to the feeding point 16 and both of the end surfaces are covered with the conductive tape member. Whether or not to mold the entire tag with the mold resin 22 hereafter as illustrated in FIG. 13 is determined according to an application purpose of the tag 20.

Furthermore, both of the end surfaces covered with the conductive tape member are not limited to the configuration of being covered with the conductive tape member. For example, both of the end surfaces including the ends of the metal 24 on the front and the back surfaces may be plated.

Fourth Embodiment

Figure 15:
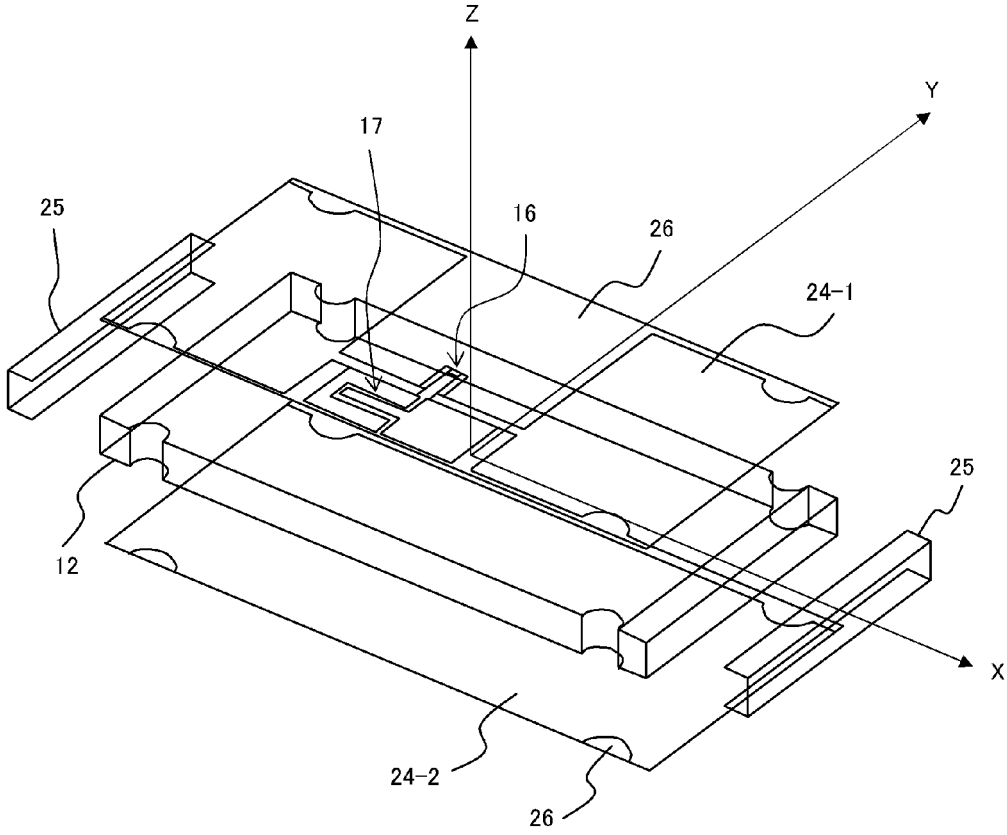
FIG. 15 is a disassembled perspective view for explaining another specific method for manufacturing the loop antenna of the tag according to the present invention, as a fourth embodiment.

FIG. 15 is a disassembled perspective view explaining another specific method for manufacturing the loop antenna of the tag according to the present invention, as a fourth embodiment. Figures and descriptions provided below refer to the configuration of the tag 20 according to the second embodiment illustrated in FIG. 7. Note that, the loop antenna 15 of the tag 11 according to the first embodiment illustrated in FIG. 5 is similar.

With the method for manufacturing the loop antenna illustrated in FIG. 15, the dielectric substrate 12 to which a conductor of Cu, Ag, etc. is not attached is initially prepared.

Next, metal foil is formed by printing, coating, evaporating, etc. the metal 24 (24-1, 24-2) onto insulative sheet members 26, the metal foil (24-2) formed on the entirety of the surface is made to contact one of the surfaces (the lower surface in FIG. 15) of the dielectric substrate 12, and the metal on which the feeding point 6 and the capacitance part 17 are formed by being etched are put on the other surface (the upper surface in FIG. 15) of the dielectric substrate 12.

Then, the upper and the lower insulative sheet members 26 are fixed to the dielectric substrate 12 by pasting the conductive tape member 25 to cover both ends of the upper and the lower insulative sheet members 26.

Also in this case, the process step of connecting the electrodes of the LSI package 100 to the feeding point 16 may be performed immediately after the feeding point 6 and the capacitance part 17 are formed with etching, or after the upper and the lower insulative sheet members 26 are fixed to the dielectric substrate 12.

Additionally, the conductive tape member 25 may be pasted after the upper and the lower insulative sheet members 26 are fixed to the dielectric substrate 12 with a dielectric adhesive.

Furthermore, the loop antenna metal 24-1 and 24-2 on the upper and the lower insulative sheet members 26 may be connected not only by pasting the conductive tape member 25 but also by plating the end surfaces including the ends of the metal 24, if the upper and the lower insulative sheet members 26 are fixed to the dielectric substrate 12 with the dielectric adhesive as described above.

Also in this case, the manufacturing of the tag is finished in the state where the LSI package 100 is connected to the feeding point 16 and both of the end surfaces are covered with the conductive tape member. Therefore, whether or not to mold the entire tag with the mold resin 22 hereafter as illustrated in FIG. 13 is determined according to an application purpose of the tag.

As described above, with the loop antenna according to the present invention, a tag antenna that can be attached to a metal can be provided by using a small inexpensive dielectric substrate that is approximately 50 mm×25 mm×5.4 mm in size, and has a permittivity $\in r$ of approximately 3.7.

What is claimed is:

1. A loop antenna, comprising:

a dielectric substrate taking a cuboid form;

a loop part composed of a metal that covers two pairs of facing surfaces of the dielectric substrate by leaving a blank portion at a center of one surface of the pair of facing surfaces having a wider area;

a feeding point to an LSI chip formed in the blank portion of the loop part; and a capacitance part formed by being connected to the loop part in parallel to the feeding point.

2. The loop antenna according to claim 1, wherein the capacitance part is composed of conductors closely arranged at two positions via a gap.

3. The loop antenna according to claim 2, wherein in the capacitance part, the conductors arranged at the two positions take a form of almost identical rectangles.

4. The loop antenna according to claim 2, wherein the capacitance part is configured by forming a concave part in one of the conductors arranged at the two positions, and by forming a convex part, which protrudes into the concave part, in the other conductor.

5. The loop antenna according to claim 2, further comprising a resin material that molds the dielectric substrate, the loop part, the feeding point, and the capacitance part along with the LSI chip.

6. The loop antenna according to claim 1, wherein the metal that covers the pair of facing surfaces having a wider area is a thin plate or foil formed integrally with the dielectric substrate in advance by being coated or pasted onto the dielectric substrate, and the feeding point and the capacitance part are formed by etching the metal thin plate or foil.

7. The loop antenna according to claim 6, wherein the metal that covers the pair of facing surfaces having a narrower area among the two pairs of facing surfaces of the dielectric substrate is a metal to be plated.

8. The loop antenna according to claim 6, wherein the metal that covers the pair of facing surfaces having a narrower area among the two pairs of facing surfaces of the dielectric substrate is a conductive tape member.

9. The loop antenna according to claim 6, further comprising a resin material that molds the dielectric substrate, the loop part, the feeding point, and the capacitance part along with the LSI chip.

10. The loop antenna according to claim 1, wherein the metal that covers one surface of the pair of facing surfaces having a wider area is a conductive sheet pasted onto the dielectric substrate later, and the metal that covers the other surface is a conductive sheet pasted onto the dielectric substrate after the feeding point and the capacitance part are formed in advance and pasted onto a non-conductive sheet.

11. The loop antenna according to claim 10, wherein the metal that covers the pair of facing surfaces having a narrower area among the two pairs of facing surfaces of the dielectric substrate is a metal to be plated.

12. The loop antenna according to claim 10, wherein the metal that covers the pair of facing surfaces having a narrower area among the two pairs of facing surfaces of the dielectric substrate is a conductive tape member.

13. The loop antenna according to claim 10, further comprising a resin material that molds the dielectric substrate, the loop part, the feeding point, and the capacitance part along with the LSI chip.

14. The loop antenna according to claim 1, further comprising a resin material that molds the dielectric substrate, the loop part, the feeding point, and the capacitance part along with the LSI chip.

15. A wireless tag comprising a loop antenna, wherein the loop antenna comprising:

a dielectric substrate taking a cuboid form;

a loop part composed of a metal that covers two pairs of facing surfaces of the dielectric substrate by leaving a blank portion at a center of one surface of the pair of facing surfaces having a wider area;

a feeding point to an LSI chip formed in the blank portion of the loop part; and a capacitance part formed by being connected to the loop part in parallel to the feeding point.

16. The wireless tag according to claim 15, wherein the capacitance part is composed of conductors closely arranged at two positions via a gap.

17. The wireless tag according to claim 15, wherein the metal that covers the pair of facing surfaces having a wider area is a thin plate or foil formed integrally with the dielectric substrate in advance by being coated or pasted onto the dielectric substrate, and the feeding point and the capacitance part are formed by etching the metal thin plate or foil.

18. The wireless tag according to claim 15, wherein the metal that covers one surface of the pair of facing surfaces having a wider area is a conductive sheet pasted onto the dielectric substrate later, and the metal that covers the other surface is a conductive sheet pasted onto the dielectric substrate after the feeding point and the capacitance part are formed in advance and pasted onto a non-conductive sheet.

* * * * *